US005080687A

United States Patent [19]

Langer et al.

[11] Patent Number: 5,080,687

[45] Date of Patent: Jan. 14, 1992

[54] METHOD OF RECOVERING REGENERATED SIZES

[75] Inventors: Jörg Langer, Wiesbaden; Günter Rösch, Bad Soden am Taunus; Heinz E. Schneider, Havixbeck, all of Fed. Rep. of Germany

[73] Assignee: Hoechst Aktiengesellschaft, Frankfurt am Main, Fed. Rep. of Germany

[21] Appl. No.: 257,334

[22] Filed: Oct. 13, 1988

[30] Foreign Application Priority Data

Oct. 15, 1987 [DE] Fed. Rep. of Germany ..... 3734915

[51] Int. Cl.[5] ..... D01F 13/00

[52] U.S. Cl. ..... 8/115.6; 8/115.51

[58] Field of Search ..... 8/115.6, 115.51, 141, 8/108.1; 106/194, 213; 127/33, 70; 525/330.3, 330.6, 61

[56] References Cited

U.S. PATENT DOCUMENTS 3,801,273 4/1974 Mays ..... 8/141

4,643,736 2/1987 Cholley ..... 8/108.1

*Primary Examiner*—Prince Willis, Jr.

*Assistant Examiner*—John F. McNally

*Attorney, Agent, or Firm*—Connolly & Hutz

[57] ABSTRACT

Process for working up regenerated sizes by adding oxidative chlorine-containing compounds, in particular sodium chlorite. These compounds have the effect in the regenerated size of oxidatively brightening the interfering dark-colored impurities.

3 Claims, No Drawings

METHOD OF RECOVERING REGENERATED SIZES

DESCRIPTION

Size recovery is becoming more and more important for economic and environmental reasons. However, from singeing and the natural impurities in cotton, the cloth contains a large number of impurities which, in the course of size washoff, pass from the fabric into the resulting regenerated size and impart to the latter a dark self-color. This self-color makes it impossible to size white or colored yarns with regenerated size without affecting the appearance of the yarns. This is important in particular when the size is not removed but is left as a finish in the fabric, as for example in the case of mattress duck and fashionable sportswear or with any fabric dyed in white, pastel-colored and bright shades. It is therefore an object of the present invention to work up the regenerated sizes in such a way that all or substantially all the dark color disappears.

This object is achieved by adding oxidative, chlorine-containing compounds, preferably sodium chlorite, to the regenerated sizes.

The amount of sodium chlorite is about 0.1 to 3% by weight per liter of regenerated size. These regenerated sizes contain in general from 1 to 12% by weight of solid sizing agent. Possible sizing agents of this type here are for example polyvinyl alcohol, carboxymethylcellulose, polyacrylates, carboxymethyl starch, guar derivatives, polyester resins or vinyl acetate/acrylate copolymers.

If sodium chlorite is used as the chlorine-containing compound, the otherwise customary activation with an acid or an acidic salt can be dispensed with, since the oxidation takes place close to neutral without significant quantities of chlorine dioxide being detected. The oxidation can be further enhanced by adding to the regenerated size, shortly before the bleaching process has ended, small amounts of active chlorine in the form of sodium hypochlorite. The ratio of sodium hypochlorite:sodium chlorite can be between 1:1 and 1:10.

The process according to the invention it possible not only to brighten the very dark impurities in the regenerated size but also to destroy the color of the marking dyes which are used in sizing to identify fiber blends and to distinguish right-hand and left-hand twisted yarns. It is consequently possible to color the recovered size once again. Nor is there any need to add preservatives, such as formaldehyde, since in the process according to the invention the regenerated size keeps for a prolonged period even at room temperature although no residues of sodium chlorite or chlorine dioxide are detectable. The regenerated size treated according to the invention is as usual returned to the required concentration by renewed addition of solid sizing agent and used for a new sizing process. The film-forming and sizing properties of the sizing agent are not impaired by the process according to the invention.

EXAMPLE

To 10,000 liters of regenerated size containing 4% by weight of sizing agent for 52 kg of sodium chlorite (30%) and the regenerated size was then pumped round at 80° C. for 14 hours. The sizing agent was two thirds polyvinyl alcohol and one third carboxymethyl cellulose. The process of oxidation took place without the addition of acid donors, since the liquor is self-activating despite a pH of 6.5. At the end of the stated period all the sodium chlorite had been consumed, as indicated by an iodine/potassium iodide paper.

To 400 liters of this regenerated size was then added 12 kg of hydroxypropyl starch and 1 kg of Na-alkane sulfonate.

This size was then used to size a pure cotton yarn of the following type:

Yarn count: tex 36/36; total number of ends: 7780 ends/200 cm; weft density: 16 picks/cm.

Sizing took place on a drum sizing machine containing medium high pressure squeeze rollers (2500 kg). The sizing temperature was 90° C., the drying temperature 140°/120° C. and the size wet pickup 120%.

This warp yarn was woven on a gripper machine with high efficiency. A reflectance measurement showed that 90% of the coloring substances had been removed from the regenerated size.

We claim:

1. A process for brightening and working up a regenerated size containing from 1 to 12% by weight of at least one sizing agent selected from the group consisting of polyvinyl alcohol, carboxymethylcellulose, a polyacrylate, carboxymethyl starch, a guar derivative, a polyester resin, and a vinylacetate or acrylate copolymer, said regenerated size having been washed off from a fabric and containing therein dark-colored impurities, which process comprises:

adding 0.1 to 3% by weight of sodium chlorite per liter of regenerated size to the regenerated size and then brightening the dark-colored impurities by oxidation, and working up the thus-brightened regenerated size which is suitable for use in a further sizing process.

2. The process as claimed in claim 1, wherein the brightening of the dark-colored impurities by oxidation is enhanced by adding medium sodium hypochlorite to the regenerated size.

3. The process as claimed in claim 2, wherein the sodium hypochlorite:sodium chlorite ratio resulting in the regenerated size during said brightening step ranges from 1:1 to 1:10.

* * * * *